US007856826B2

(12) United States Patent
Brown et al.

(10) Patent No.: US 7,856,826 B2
(45) Date of Patent: Dec. 28, 2010

(54) COMBUSTOR DOME MIXER RETAINING MEANS

(75) Inventors: Daniel Dale Brown, Cincinnati, OH (US); Michael Terry Bucaro, Liberty Township, OH (US); Jeff Martini, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 1300 days.

(21) Appl. No.: 11/558,652

(22) Filed: Nov. 10, 2006

(65) Prior Publication Data

US 2008/0110022 A1 May 15, 2008

(51) Int. Cl.
*F02C 1/00* (2006.01)
*F02G 3/00* (2006.01)

(52) U.S. Cl. ..... 60/752; 60/796; 60/798; 60/800; 60/758; 60/804

(58) Field of Classification Search ..... 60/796, 60/798, 800, 758, 804, 752
See application file for complete search history.

(56) References Cited

U.S. PATENT DOCUMENTS 3,854,285 A 12/1974 Stenger et al.
4,232,527 A 11/1980 Reider
5,237,820 A 8/1993 Kastl et al.
5,323,604 A 6/1994 Ekstedt et al.
5,630,319 A 5/1997 Schilling et al.
5,865,024 A 2/1999 Kress et al.
6,314,739 B1 11/2001 Howell et al.
6,334,298 B1 1/2002 Aicholtz
6,502,400 B1 1/2003 Freidauer et al.
6,725,667 B2 4/2004 Farmer et al.
6,976,363 B2 12/2005 McMasters et al.
7,062,920 B2 6/2006 McMasters et al.
7,222,488 B2 * 5/2007 Farmer et al. ..... 60/747
2005/0034460 A1 * 2/2005 McMasters et al. ..... 60/752

* cited by examiner

*Primary Examiner*—Michael Cuff
*Assistant Examiner*—Craig Kim
(74) *Attorney, Agent, or Firm*—William Scott Andes, Esq.; Armstrong Teasdale LLP

(57) ABSTRACT

A method of assembling a combustor for use in a turbine engine is disclosed. The method includes providing a dome assembly ring including a plurality of assembly ring openings, positioning a plurality of elongated rings on the dome assembly ring, providing a cowl assembly including an inner cowl portion and an outer cowl portion that are fabricated from sheet metal, and coupling the inner and outer cowl portions to the dome assembly ring such that each of the plurality of elongated rings is coupled to the dome assembly ring.

20 Claims, 5 Drawing Sheets

COMBUSTOR DOME MIXER RETAINING MEANS

BACKGROUND OF THE INVENTION

This invention relates generally to gas turbines, and more particularly, to combustor dome mixer retainers used with turbine engines.

At least some known gas turbine engines use a lean dome combustor that includes a center mixer assembly that is formed integrally with a fuel nozzle and a dome-mounted mixer assembly that forms a portion of a dome assembly. As a result, at least some known dome mixer assemblies are large and may be difficult to retain using only the dome.

Known methods of assembling such combustors generally includes retaining or rigidly coupling mixers to the dome via welding or brazing. The inner and outer cowls may be formed with retaining means that are used to maintain the mixers in position. Incorporating the retaining means requires providing enough material for both the retaining means and the cowl. For example, forging weights of inner and outer cowls may be 55 pounds and 135 pounds, respectively. However, final machined inner and outer cowl weights may be 1.6 pounds and 5.7 pounds, respectively, such that 183 pounds of material waste is generated per engine.

Consequently, combustors assembled using known fabrication methods use retaining means that require additional material and labor resulting in increased maintenance and manufacturing costs.

BRIEF DESCRIPTION OF THE INVENTION

In one aspect, a method of assembling a combustor for use in a turbine engine is disclosed. The method includes providing a dome assembly ring including a plurality of assembly ring openings, positioning a plurality of elongated rings on the dome assembly ring, providing a cowl assembly including an inner cowl portion and an outer cowl portion that are fabricated from sheet material, and coupling the inner and outer cowl portions to the dome assembly ring such that each of the plurality of elongated rings is coupled to the dome assembly ring.

In another aspect, a mixer retainer assembly for use in a turbine engine combustor is disclosed. The retainer assembly includes a dome assembly ring including a plurality of assembly ring openings, a plurality of elongated rings positioned on the dome assembly ring, an inner cowl fabricated from sheet material, and an outer cowl fabricated from sheet material. The inner cowl and the outer cowl are coupled to the dome assembly ring such that each of the plurality of elongated rings is coupled to the dome assembly ring.

In yet another aspect, a combustor assembly for use in a turbine engine is disclosed. The assembly includes a dome ring comprising a plurality of ring openings, a plurality of elongated rings positioned on said dome ring, an inner cowl fabricated from sheet material, and an outer cowl fabricated from sheet material. The inner cowl and the outer cowl are coupled to the dome ring such that each of the plurality of elongated rings is coupled to the dome ring and such that the inner cowl and the outer cowl together constitute a single cowl.

DETAILED DESCRIPTION OF THE INVENTION

Figure 1:
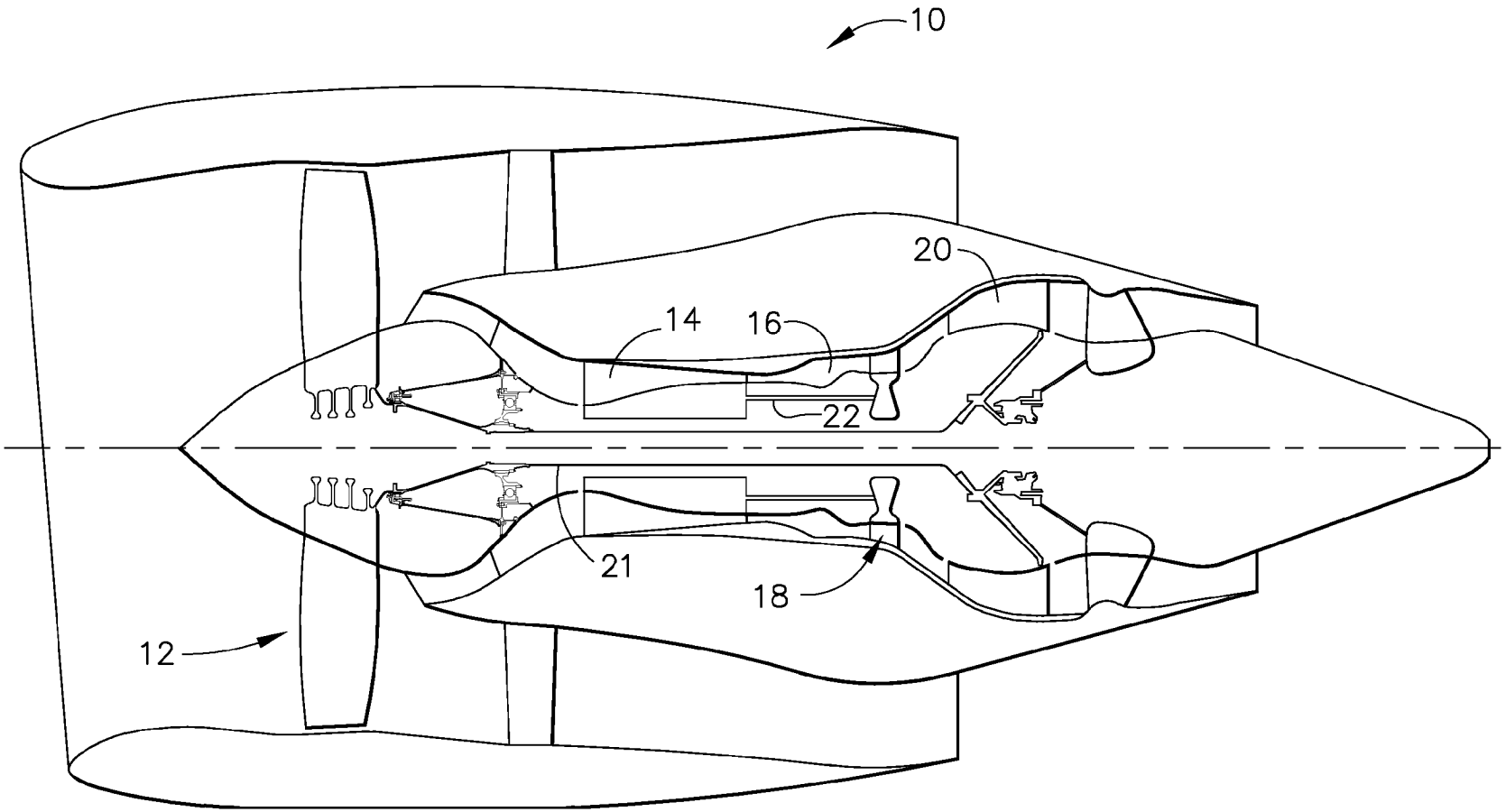
FIG. 1 is a schematic illustration of an exemplary turbine engine.

FIG. 1 is a schematic illustration of an exemplary gas turbine engine 10. Engine 10 includes a low pressure compressor 12, a high pressure compressor 14, and a combustor assembly 16. Engine 10 also includes a high pressure turbine 18, and a low pressure turbine 20 arranged in a serial, axial flow relationship. Compressor 12 and turbine 20 are coupled by a first shaft 21, and compressor 14 and turbine 18 are coupled by a second shaft 22. In the exemplary embodiment, gas turbine engine 10 is a CFM56 gas turbine engine or CF34-10 that are available from General Electric Company, Cincinnati, Ohio.

Figure 2:
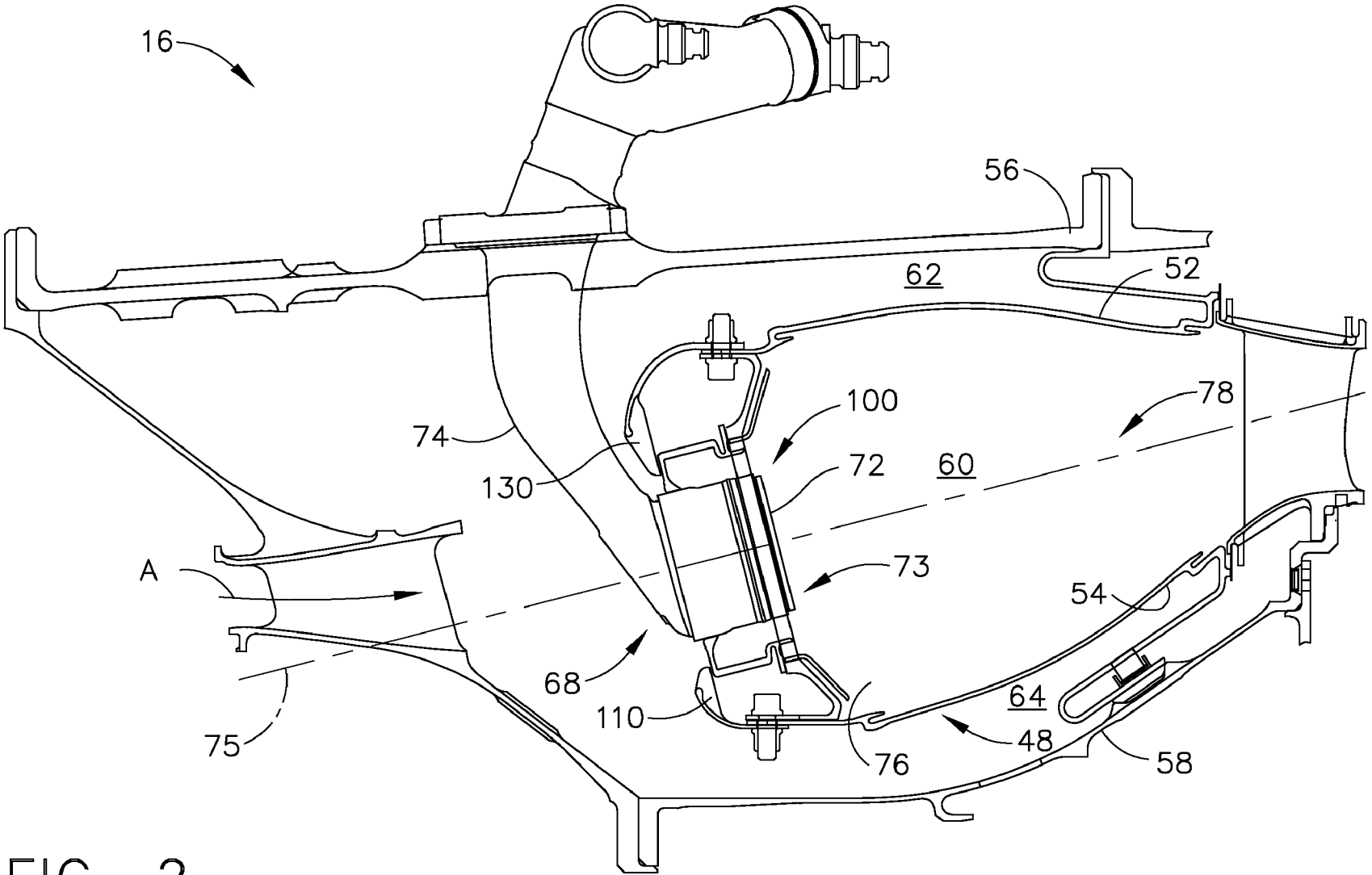
FIG. 2 is a schematic cross-sectional view of an exemplary combustor that may be used with the turbine engine shown in FIG. 1.

FIG. 2 is a schematic cross-sectional view of an exemplary combustor 16 that may be used with gas turbine engine 10 (shown in FIG. 1). Combustor 16 includes an outer liner 52 and an inner liner 54 disposed between an outer combustor casing 56 and an inner combustor casing 58. Outer and inner liners 52 and 54 are spaced radially from each other such that a combustion chamber 60 is defined therebetween. Outer liner 52 and outer casing 56 form an outer passage 62 therebetween, and inner liner 54 and inner casing 58 form an inner passage 64 therebetween. In the exemplary embodiment, an inner cowl 110 and an outer cowl 130 are coupled to the upstream ends of inner and outer liners 54 and 52, respectively. An annular opening 68 formed between inner cowl 110 and outer cowl 130 enables compressed fluid to enter combustor 16 through a diffuse opening in a direction generally indicated by arrow A. The compressed fluid flows through annular opening 68 to support combustion and to facilitate cooling liners 52 and 54. It should be appreciated that the term "fluid" as used herein includes any material or medium that flows, including, but not limited to, gas and air.

An annular dome assembly 100 extends between, and is coupled to, outer and inner liners 52 and 54 near their upstream ends. Each swirler assembly 72 receives compressed air from opening 68 and fuel from a corresponding fuel injector 74. Fuel and air are swirled and mixed together by swirler assemblies 72, and the resulting fuel/air mixture is discharged into combustion chamber 60. Combustor 16 includes a longitudinal axis 75 which extends from a forward end 76 to an aft end 78 of combustor 16. In the exemplary embodiment, combustor 16 is a single annular combustor. Alternatively, combustor 16 may be any other combustor, including, but not limited to a double annular combustor.

Figure 3:
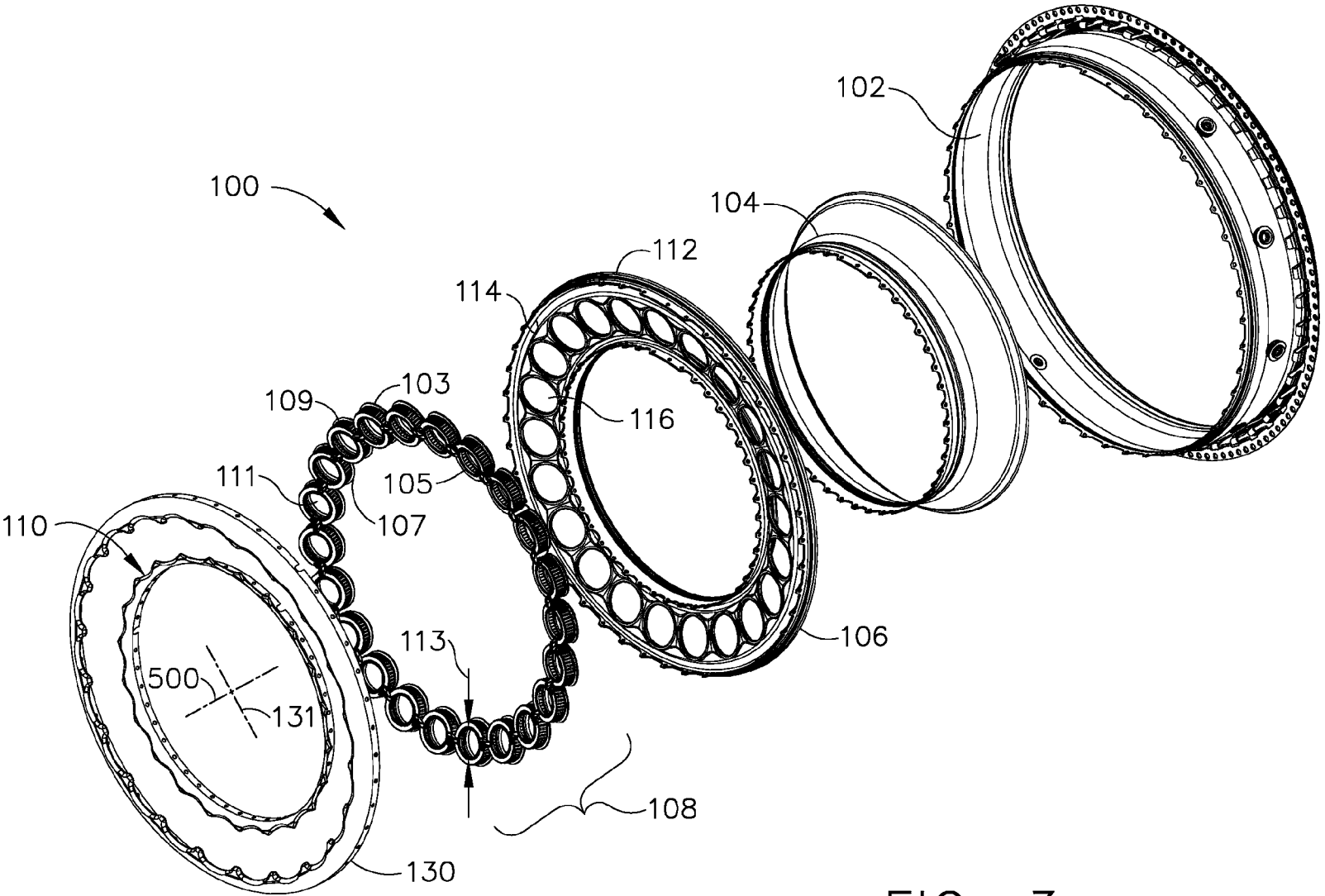
FIG. 3 is an exploded view of an exemplary dome assembly that can be used with the combustor shown in FIG. 2.

FIG. 3 is an exploded view of annular dome assembly 100 that can be used with combustor 16 (shown in FIG. 2). In the exemplary embodiment, dome assembly 100 includes a dome assembly ring 106, an inner liner portion 104, an outer liner portion 102, a plurality of mixers 108, an inner cowl 110, and an outer cowl 130. Dome assembly ring 106 has an annular configuration that includes a first side 112, second side 114, and a plurality of circumferentially spaced circular openings 116. Inner liner portion 104 and outer liner portion 102 are coupled to first side 112 of dome assembly ring 106.

Mixers 108 include a plurality of swirlers 109 that are each sized and shaped to correspond to each of the plurality of openings 116 of assembly ring 106. More specifically, each swirler 109 is configured as an elongated ring having a first circular end 103, a second circular end 105, and a plurality of circumferentially and uniformly spaced members 107 extending therebetween. Each swirler 109 defines an opening 111 having a diameter 113. It should be appreciated that members 107 may be any length and opening 111 may have any diameter 113 that enables dome assembly 100 to function as described herein. Although the exemplary embodiment describes swirlers 109 as each having a circular cross-section that is sized and shaped to correspond to openings 116, other embodiments may use swirlers 109 having any shape or size that enables swirlers 109 to function as described herein.

Figure 4:
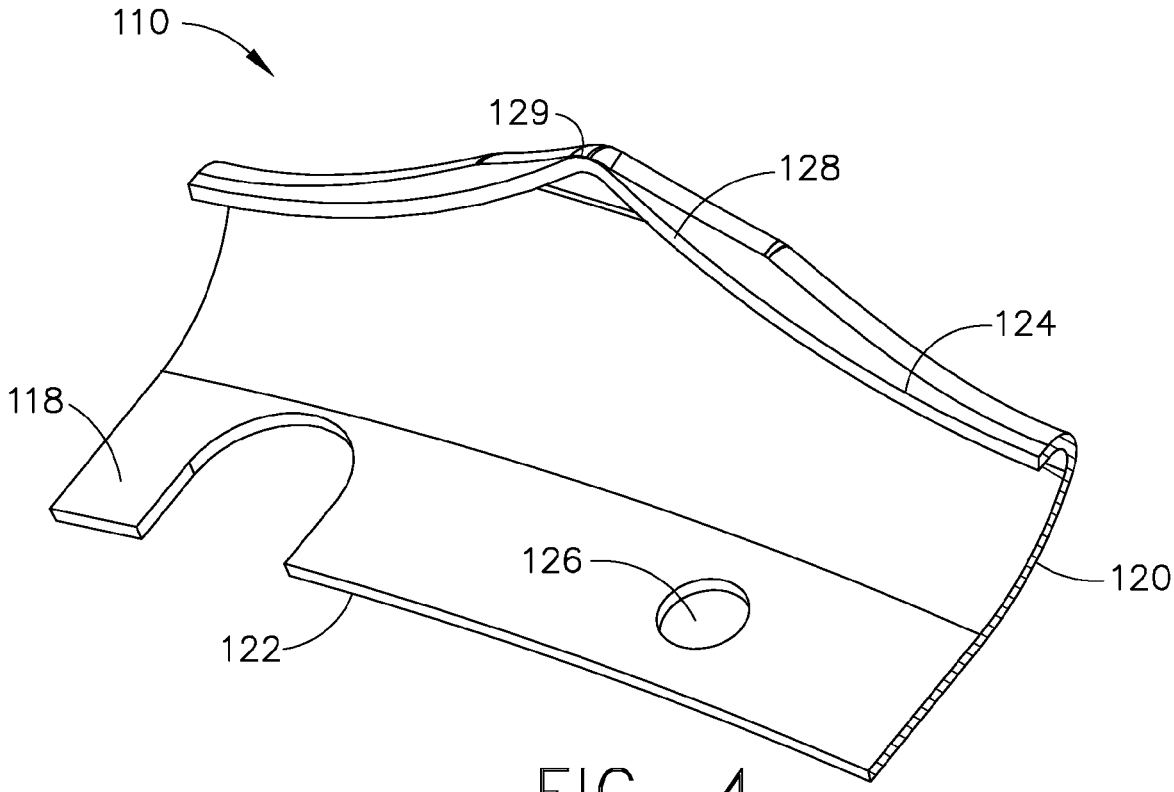
FIG. 4 is an enlarged perspective view of a segment of an exemplary inner cowl that can be used with the combustor shown in FIG. 2.

FIG. 4 is an enlarged perspective view of a segment of inner cowl 110 that can be used with combustor 16 (shown in FIG. 2). In the exemplary embodiment, inner cowl 110 is fabricated from sheet metal and has an annular shape. Furthermore, inner cowl 110 includes an inner surface 118, an outer surface 120, a first edge 122, a second edge 124, and a plurality of circumferentially and uniformly spaced openings 126. Moreover, second edge 124 is configured to include a plurality of circumferentially and uniformly spaced inner cowl lips 128 such that second edge 124 has an arcuate configuration between adjacent inner cowl lips 128. Each inner cowl lip 128 extends away from inner surface 118 towards a center 500 of inner cowl 110 and is configured to define an inner cowl terminus 129. It should be appreciated that although the exemplary embodiment describes inner cowl 110 as being fabricated from sheet metal, other embodiments may use any type of sheet material that enables inner cowl 110 to function as described herein.

Figure 5:
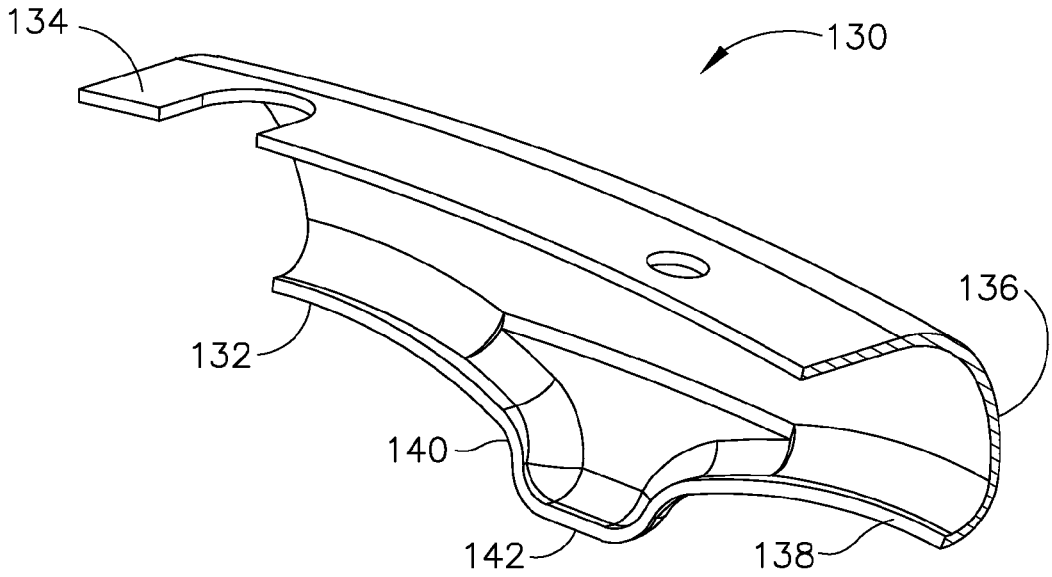
FIG. 5 is an enlarged perspective view of a segment of an exemplary outer cowl that can be used with the combustor shown in FIG. 2.

FIG. 5 is an enlarged perspective view of a segment of outer cowl 130 that can be used with combustor 16 shown in FIG. 2. In the exemplary embodiment, outer cowl 130 is fabricated from sheet metal and has an annular shape. Outer cowl 130 includes a first leg 132 and a second leg 134 connected by a bend 136. First leg 132 defines a first leg edge 138 configured to include a plurality of circumferentially and uniformly spaced outer cowl lips 140 such that first leg edge 138 has an arcuate configuration between adjacent outer cowl lips 140. Each outer cowl lip 140 extends away from outer cowl 130 towards a center 131 of outer cowl 130 and is configured to define an outer cowl terminus 142. It should be appreciated that although the exemplary embodiment describes outer cowl 130 as being fabricated from sheet metal, other embodiments may use any type of sheet material that enables outer cowl 130 to function as described herein.

Figure 6:
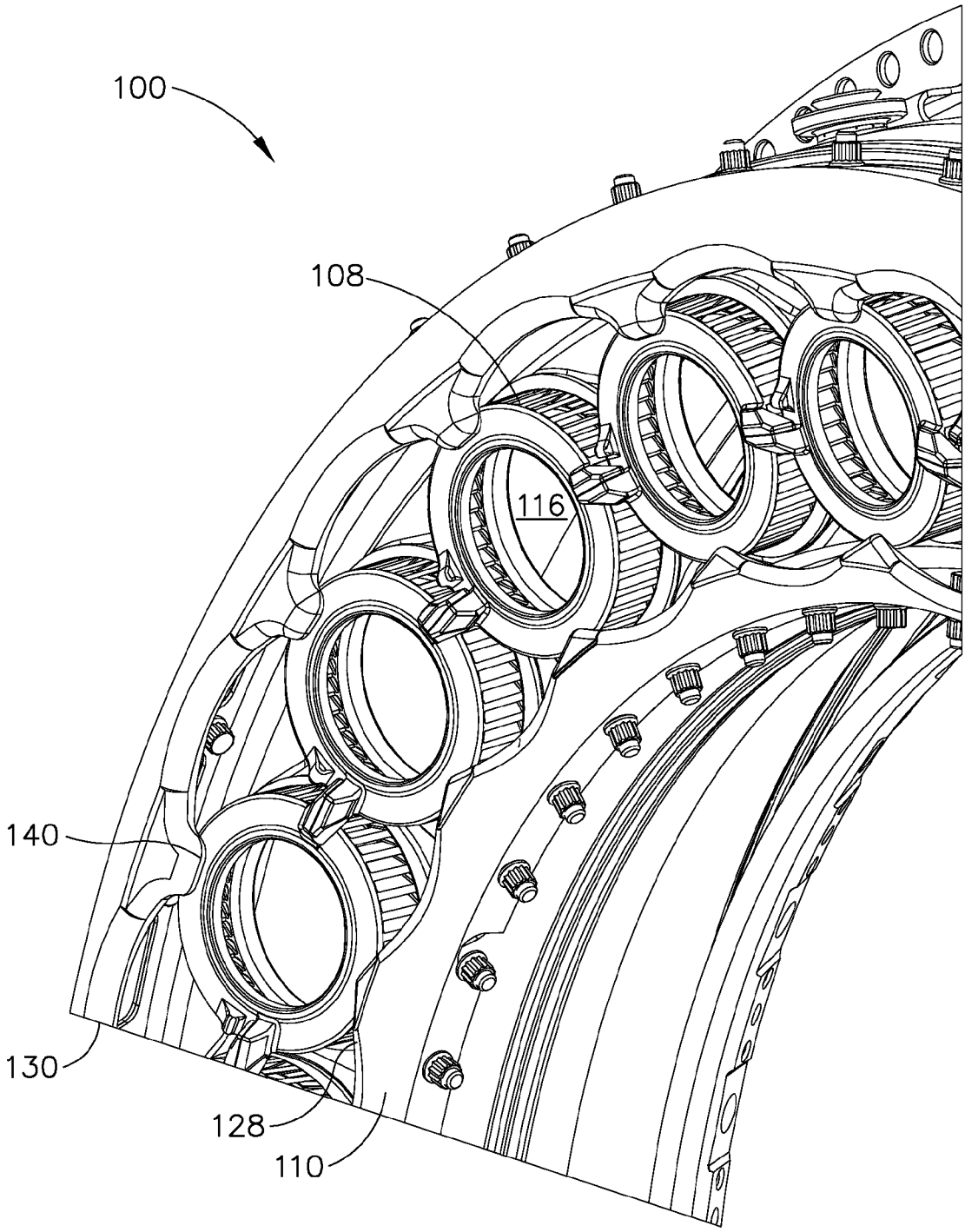
FIG. 6 is an enlarged perspective view of a segment of a dome assembly including mixers, inner cowl and outer cowl.

FIG. 6 is a perspective view of a segment of dome assembly 100 including mixers 108, inner cowl 110 and outer cowl 130. In the exemplary embodiment, each of the plurality of swirlers 109 is substantially aligned with a respective one of the openings 116 defined in dome assembly ring 106. More specifically, first circular end 103 of each swirler 109 is positioned against first side 112 of assembly ring 106 such that opening 111 concentrically aligns with a corresponding opening 116 of assembly ring 106. It should be appreciated that although the exemplary embodiment describes concentrically aligning respective openings 111 and 116, other embodiments may align openings 111 and 116 in any manner that enables dome assembly 100 to function as described herein. Inner and outer cowls 110 and 130, respectively, are then installed.

Inner cowl 110 is positioned such that each inner cowl lip 128 is aligned with and corresponds to one of swirlers 109. Consequently, each one of inner cowl lips 128 is positioned against a corresponding one of the plurality of swirlers 109, thus facilitating providing cyclonic retention of swirlers 109. Likewise, outer cowl 130 is positioned such that each outer cowl lip 140 is adjacent a corresponding swirler 109. Consequently, each one of the plurality of outer cowl lips 140 is positioned against one of the plurality of swirlers 109, thus facilitating providing cyclonic retention of swirlers 109. Each of the plurality of inner cowl lips 128 is positioned on each of the plurality of swirlers 109 such that each inner cowl lip 128 is diametrically opposed to a corresponding one of the outer cowl lips 140 positioned on the same swirler 109. Thus, each swirler 109 is retained in position exclusively by an inner cowl lip 128 and an outer cowl lip 140. No other retaining means, or technique, such as, but not limited to, brazing and welding is required. It should be appreciated that although the exemplary embodiment describes inner cowl lips 128 and outer cowl lips 140 as being diametrically positioned relative to each other on a swirler 109, other embodiments may position inner cowl lips 128 with respect to outer cowl lips 140 in any manner that enables inner cowl 110 and outer cowl 130 to function as described herein. Moreover, it should be appreciated that inner cowl 110 and outer cowl 130, upon constructing dome assembly 100, together constitute a single cowl.

The above-described method and apparatus facilitates retaining swirlers in a dome assembly that may be installed in a combustor. Specifically, the inner and outer cowls may be fabricated from sheet metal to have a plurality of circumferentially and uniformly spaced lips. Each cowl is installed such that each lip is positioned to correspond with a swirler. The inner cowl lips and the outer cowl lips are diametrically opposed with respect to each other on each swirler and each apply a retaining force to the swirler. As a result, the inner and outer cowl lips facilitate retaining each swirler in position.

In one embodiment, a method of retaining combustor mixers for use in a turbine engine combustor is disclosed. The method includes providing a dome assembly ring comprising a plurality of assembly ring openings, providing a plurality of elongated rings and positioning each of the plurality of elongated rings on the dome assembly ring, forming an inner cowl and an outer cowl from sheet metal, and coupling the inner and outer cowls to the dome assembly ring such that each of the plurality of elongated rings is coupled to the dome assembly ring.

In each embodiment the above-described inner and outer cowls facilitate reducing component part costs. More specifically, in each embodiment, the method facilitates reducing costs by fabricating the cowls from sheet metal material instead of machining them from forgings. As a result, less expensive cowls may be used to retain mixers. Accordingly, turbine engine performance and component useful life are each facilitated to be enhanced in a cost effective and reliable manner.

Although the method and apparatus described herein are described in the context of retaining mixers in a gas turbine engine, it is understood that the method and apparatus are not limited to gas turbine engines or combustors. Likewise, the gas turbine engine and combustor liner components illustrated are not limited to the specific embodiments described herein, but rather, components of both the gas turbine engine and the combustor liner can be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a combustor for use in a turbine engine, said method comprising:

providing a dome assembly ring including a plurality of assembly ring openings;

positioning a plurality of elongated rings on the dome assembly ring;

providing a cowl assembly including an inner cowl portion and a separate outer cowl portion that are each fabricated from sheet material, wherein at least one of the inner cowl portion and the outer cowl portion includes a plurality of circumferentially and uniformly spaced cowl lips, wherein each inner cowl lip extends away from an inner surface of the inner cowl portion towards a center of the inner cowl portion to define an inner cowl terminus configured to engage a swirler and wherein each outer cowl lip extends away from the outer cowl towards a center of the outer cowl portion to define an outer cowl terminus configured to engage a swirler; and coupling the inner and outer cowl portions to the dome assembly ring such that each of the plurality of elongated rings is coupled to the dome assembly ring.

2. A method in accordance with claim 1 wherein coupling inner and outer cowl portions further comprises coupling the inner cowl portion to the dome assembly ring.

3. A method in accordance with claim 2 further comprising positioning the inner cowl portion such that each of the plurality of inner cowl lips is substantially aligned with one of the plurality of rings.

4. A method in accordance with claim 1 wherein coupling inner and outer cowl portions further comprises coupling the outer cowl portion to the dome assembly ring.

5. A method in accordance with claim 4 further comprising positioning the outer cowl portion such that each of the plurality of outer cowl lips is substantially aligned with one of the plurality of rings.

6. A method in accordance with claim 1 further comprising positioning each of the plurality of elongated rings in substantial alignment with one of the plurality of assembly ring openings.

7. A method in accordance with claim 1 further comprising retaining each of the plurality of rings in position against the dome assembly ring by contacting a perimeter of each of the plurality of rings.

8. A mixer retainer assembly for use in a turbine engine combustor, said retainer comprising:

a dome assembly ring comprising a plurality of assembly ring openings;

a plurality of elongated rings positioned on said dome assembly ring;

an inner cowl fabricated from sheet material, said inner cowl comprising an edge including a plurality of circumferentially and uniformly spaced inner cowl lips such that said edge has an arcuate configuration between adjacent inner cowl lips; and an outer cowl fabricated from sheet material, said outer cowl comprising an edge including a plurality of circumferentially and uniformly spaced cowl lips, said inner cowl and said outer cowl are coupled to said dome assembly ring such that each of said plurality of elongated rings is coupled to said dome assembly ring, wherein each inner cowl lip extends away from an inner surface of the inner cowl portion towards a center of the inner cowl portion to define an inner cowl terminus configured to engage a swirler and wherein each outer cowl lip extends away from the outer cowl towards a center of the outer cowl portion to define an outer cowl terminus configured to engage the swirler.

9. A mixer retainer assembly in accordance with claim 8 wherein said inner cowl comprises a plurality of circumferentially spaced cowl lips.

10. A mixer retainer assembly in accordance with claim 9 wherein each of said plurality of inner cowl lips is substantially aligned with one of said plurality of rings.

11. A mixer retainer assembly in accordance with claim 8 wherein said outer cowl comprises a plurality of circumferentially spaced cowl lips.

12. A mixer retainer assembly in accordance with claim 11 wherein each of said plurality of cowl lips is substantially aligned with one of said plurality of rings.

13. A mixer retainer assembly in accordance with claim 8 wherein each of said plurality of elongated rings is substantially aligned with one of said plurality of assembly ring openings.

14. A mixer retainer assembly in accordance with claim 8 wherein said inner cowl and said outer cowl are coupled to said dome assembly ring such that said inner cowl and said outer cowl together constitute a single cowl.

15. A combustor assembly for use in a turbine engine, said assembly comprising:

a dome ring comprising a plurality of ring openings;

a plurality of elongated rings positioned on said dome ring;

an inner cowl fabricated from sheet material, said inner cowl comprising an edge including a plurality of circumferentially and uniformly spaced inner cowl lips such that said edge has an arcuate configuration between adjacent inner cowl lips; and an outer cowl fabricated from sheet material, said outer cowl comprising an edge including a plurality of circumferentially and uniformly spaced cowl lips, said inner cowl and said outer cowl are coupled to said dome ring such that each of said plurality of elongated rings is coupled to said dome assembly ring and such that said inner cowl and said outer cowl together constitute a single cowl, wherein each inner cowl lip extends away from an inner surface of the inner cowl portion towards a center of the inner cowl portion to define an inner cowl terminus configured to engage a swirler and wherein each outer cowl lip extends away from the outer cowl towards a center of the outer cowl portion to define an outer cowl terminus configured to engage the swirler.

16. An assembly in accordance with claim 15 wherein said inner cowl comprises a plurality of circumferentially spaced cowl lips.

17. An assembly in accordance with claim 16 wherein each of said plurality of cowl lips is substantially aligned with one of said plurality of rings.

18. An assembly in accordance with claim 15 wherein said outer cowl comprises a plurality of circumferentially spaced cowl lips.

19. An assembly in accordance with claim 18 wherein each of said plurality of cowl lips is substantially aligned with one of said plurality of rings.

20. An assembly in accordance with claim 15 wherein each of said plurality of elongated rings is substantially aligned with one of said plurality of ring openings.

* * * * *